United States Patent [19]

Bres et al.

[11] Patent Number: 4,908,549

[45] Date of Patent: Mar. 13, 1990

[54] MOTOR-DRIVEN DEVICE FOR PREADJUSTED FREQUENCY TUNINGS FOR A KLYSTRON

[75] Inventors: Michel Bres, Versailles; François Tisserand, Asnieres, both of France

[73] Assignee: Thomson-CSF, Paris, France

[21] Appl. No.: 279,565

[22] Filed: Dec. 5, 1988

[30] Foreign Application Priority Data

Dec. 8, 1987 [FR] France ..... 87 17053

[51] Int. Cl.[4] ..... H01J 25/10

[52] U.S. Cl. ..... 315/5.47; 315/5.46; 330/45; 331/83; 334/21

[58] Field of Search ..... 315/5.46, 5.47, 5.43, 315/5.48, 39, 5.37; 330/45; 331/7, 8, 35, 83; 334/21

[56] References Cited

U.S. PATENT DOCUMENTS

| | | | |
|---|---|---|---|
| 3,617,799 | 11/1971 | Schmidt et al. | 315/5.47 |
| 3,940,721 | 2/1976 | Kojima et al. | 315/5.48 X |
| 4,216,409 | 8/1980 | Sato et al. | 315/5.47 X |

FOREIGN PATENT DOCUMENTS

| | | | |
|---|---|---|---|
| 0177258 | 4/1986 | European Pat. Off. . | |
| 0004060 | 1/1979 | Japan | 315/5.46 |
| 2024526 | 1/1980 | United Kingdom . | |

*Primary Examiner*—Eugene R. LaRoche
*Assistant Examiner*—Seung Ham
*Attorney, Agent, or Firm*—Oblon, Spivak, McClelland, Maier & Neustadt

[57] ABSTRACT

A klystron comprises a plurality of resonant cavities, the frequency of which is defined by a piston within each cavity. In order to change the frequency of the klystron, each piston is provided with a rod applied against an adjusting screw under the pressure of a spring. In order to reduce the bulk of the springs, the distance between a screw head and the plate on which the springs are applied remains constant irrespective of the length of the adjusting screws. This is obtained by means of a set of switches which are fixed on the movable plate and control the compression of the springs by checking the position of a cup in which each spring exerts its force on the corresponding piston rod.

7 Claims, 3 Drawing Sheets

PRIOR ART FIG_1
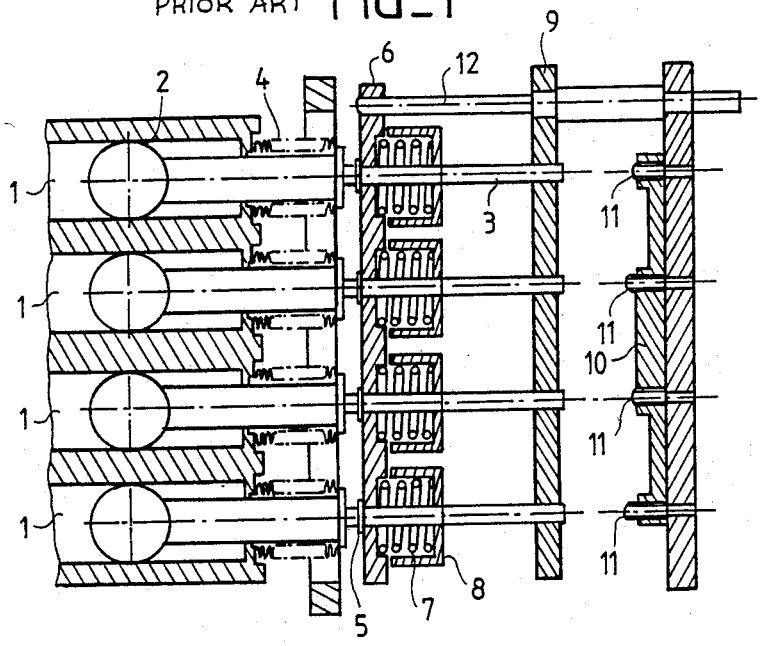
PRIOR ART FIG_2
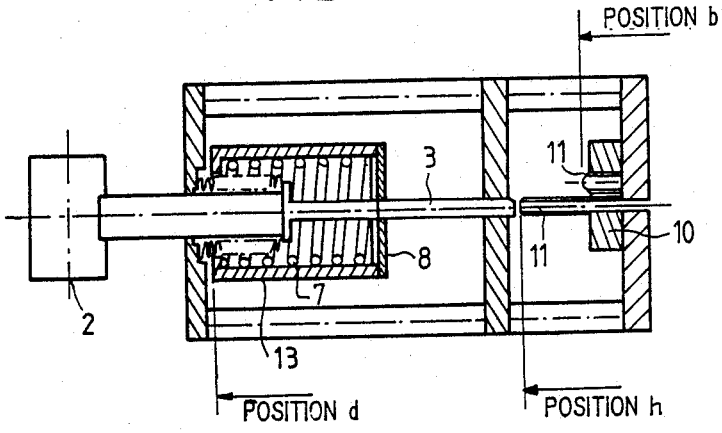

MOTOR-DRIVEN DEVICE FOR PREADJUSTED FREQUENCY TUNINGS FOR A KLYSTRON

BACKGROUND OF THE INVENTION

1. Field of the Invention

The present invention relates to a motor-driven device for preadjusted frequency tunings for a klystron. This device makes use of a known mechanical base of pistons which are inserted to a greater or lesser extent in the resonant cavities of a klystron, these pistons being extended by rods thrust by springs against adjusting screws supported by a carriage. The distinctive feature of the device lies in the fact that it does not adopt the same locking position at the different frequencies for the plate on which the springs are applied for maintaining the rods of each piston in contact with the adjusting screws. This makes it possible to employ shorter springs which are less bulky and work at their optimum value of compression. Moreover, electric switches integrated in the mechanical assembly control the respective positions of the moving parts and ensure positioning of the plate and operational safety of the system.

2. Description of the Prior Art

Klystrons are microwave generators provided with cavities. In order to obtain high power, it is known to associate a plurality of resonant cavities. One movable wall of each cavity is constituted by a piston, the displacement of which makes it possible to vary the volume of the cavity and consequently the frequency of the klystron.

The instantaneous passband of a klystron is much smaller than the mechanical tuning range, namely the frequency domain in which it can be operated. For example, in the case of a klystron which operates between 5.9 and 6.4 GHz, its tuning range of 500 MHz can be divided into twelve channels including the passband and 45 MHz in each case. In order to displace the passband within a tuning range or in other words in order to change from one channel to another, it is necessary to change the resonant frequencies of the different cavities. One method commonly employed consists in displacing a piston within resonant cavities having rectangular cross-sections. Said piston ensures an electrical contact with the sides and behaves as a movable wall of the cavity. Vacuum-tightness is ensured by means of a deformable metallic bellows seal placed behind the piston and welded to the edges of the cavity and to the rod which forms an extension of the piston.

A different position of each piston corresponds to each passband or channel. The pistons are rigidly fixed to a rod which can be displaced by means of a screw-thread. At each change of channel, it is accordingly necessary to carry out a number of adjustments corresponding to the number of pistons and therefore of cavities. It is this method which is usually employed for large klystron tubes.

For this reason, mechanical memorization devices have been designed. During operation, the piston rods are applied against movable stops. These stops are screws which are inserted to a greater or lesser extent in a movable carriage which is rectangular or in the form of a revolver with a wheel pivoted about its axis. A set of screws positioned in front of the piston rods corresponds to each channel. It is therefore necessary to have a number of screws equal to the product of the number of channels times the number of cavities.

It is also known to equip this mechanical memorization device with electric motors which replace any human agency for changing the frequency but these motors are controlled by a wired logic which is independent of the memorization device. The plate on which the springs are applied is always restored to the same locking position.

This motor-drive system has two drawbacks. The springs, one end of which is always in the same locking position, must have a sufficient length to exert a suitable pressure force in the two extreme cases of the longest adjusting screws corresponding to high frequencies and of the shortest adjusting screws corresponding to low frequencies. The springs are therefore bulky. Furthermore, the motors are programmed without knowing the mechanical state of the memorization device since this latter is purely mechanical and does not have any sensor. Thus, if an incident occurs such as pistons which have seized, screw-holding carriage in an intermediate position, and so on, the action of the electric motors may cause damage to at least the mechanical memorization device and in some instances to the klystron cavity as well.

The device in accordance with the invention makes it possible to overcome this disadvantage by intelligent control of the motors. Electric contactors integrated in the device control the position of the mechanical moving parts and control the operation of the motors. Furthermore, two contactors check the position of the two ends of each spring. Thus they stop the locking motor as soon as all the springs have attained a length which corresponds to an optimum compression ratio. This means that the springs are short and that the plate on which the springs are applied is arrested in a locking position corresponding to each frequency. Thus the displacement of the plate compensates for the lack of deflection of short springs.

SUMMARY OF THE INVENTION

In more precise terms, the invention relates to a motor-driven device for preadjusted frequency tunings for a klystron, comprising a plurality of resonant cavities, each cavity being adjusted in frequency by means of a piston rigidly fixed to a rod whose position is controlled by a spring which bears on a plate, exerts its force on a cup which is rigidly fixed to the piston rod and locks said rod against the head of an adjusting screw. The device is distinguished by the fact that, irrespective of the frequency tuning chosen and in the case of each cavity, the distance between the plate and the head of the adjusting screw is constant, the locking position of the plate being movable according to the frequency which is chosen and the spring being compressed between the plate and the cup in a constant manner.

BRIEF DESCRIPTION OF THE DRAWINGS

FIG. 1 illustrates a device for mechanical memorization of preadjusted frequency tunings in accordance with the prior art.

FIGS. 2, 3 and 4 show positions of the piston rods and springs in the unlocked and locked position at high and low frequencies respectively, in the prior art.

DETAILED DESCRIPTION OF THE INVENTION

Figure 3:
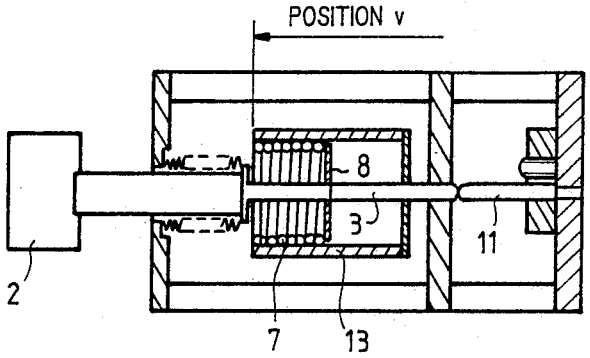
FIG 3 PRIOR ART

A preliminary review of the structure of a memorization device in accordance with the prior art and a description of its mode of operation will serve to gain a better understanding of the improvement achieved by the device in accordance with the invention. This device applies to a mechanism which is already known but which is either manually operated or operated under blind control conditions by one or two electric motors which are not provided with any position sensors in the memorization mechanism.

The left-hand portion of FIG. 1 represents the cross-section of a klystron which is composed of a plurality of resonant cavities 1. The number of resonant cavities shown here is not intended to imply any limitation of the scope of the invention. In order to tune the resonant cavities, the same plurality of pistons 2 is displaced within said cavities. These pistons are designed as cylinder elements and electrical contact between the piston and the cavity walls is ensured by a set of metallic springs. Each piston is extended towards the exterior of the resonant cavity by a rod 3. Vacuum-tightness, or containment of the vacuum maintained within the resonant cavity, is obtained by means of a bellows seal 4 welded at one end to the wall of the resonant cavity and at the other end to the piston rod 3.

In order to permit simultaneous adjustment of all the resonant cavities, each piston rod 3 has a ring 5 on which a plate 6 is applied whenever necessary. This plate serves as a bearing base for a number of springs corresponding to the number of piston rods 3 and each spring exerts a thrust on the corresponding rod 3 by means of a cup 8 which is welded to the rod 3.

This system makes it possible to apply the piston rods 3 against screws which perform the function of stops. The screws themselves are positioned so as to adjust the pistons 2 within the resonant cavities 1 to a given frequency.

With a view to ensuring better mechanical construction, the piston rods 3 are supported at their free ends by a plate 9 which permits alignment of the rods on the adjusting screws.

A movable carriage 10 designed either in the form of a rectangular carriage driven in a movement of lateral displacement or in the form of a revolver which is capable of rotating about its central axis is adapted to carry adjusting screws 11. In respect of each frequency, there are as many screws 11 as there are resonant cavities and rods 3. The number of screws is therefore equal to the product of the number of channels to be adjusted times the number of resonant cavities. In FIG. 1, four resonant cavities are shown and if the klystron is to be adjusted for six channels, for example, the number of screws is equal to twenty-four.

In FIG. 1, the mechanical device for memorizing the position of the pistons is shown in the unlocked position in which the plate 6 thrusts the pistons 2 into the lower ends of the resonant cavities 1 by bearing on rings 5 which are rigidly fixed to the piston rods 3. Thus said rods are remote from the adjusting screws 11 and it is then possible to present another set of adjusting screws 11 which are further away. Displacement of the plate 6 is obtained by means of a set of threaded rods 12 applied against the mechanical frame which ensures rigidity of the entire assembly.

The operation of a device of this type is as follows: as a result of rotation, the threaded rods 12 move the plate 6 to the unlocking position in which, irrespective of the channel, the piston rods 3 displaced by the rings 5 are released from the adjusting screws 11. The pistons 2 are therefore caused to penetrate into the cavities 1 to the maximum extent. By displacement of the carriage 10 or of the revolver which carries the adjusting screws 11, a fresh set of screws 11 is presented in front of the piston rods 3. The threaded rods 12 return the plate 6 to an initial position known as the locking position in which mechanical contact between the piston rods and the screws is ensured by the springs 7 which bear on the cups 8.

Figure 4:
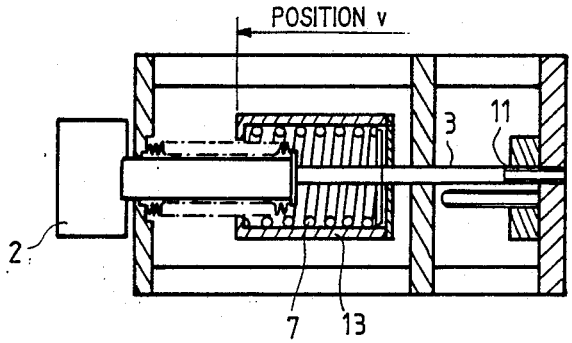
FIG 4 PRIOR ART

This presents a difficulty which is illustrated in FIGS. 2, 3 and 4. FIG. 2 is a plan view representing an assembly of pistons, rods, adjusting screws and springs considered separately. In the first place, this figure clearly shows two adjusting screws 11. One screw is short and corresponds to a piston in a substantially withdrawn position with respect to the resonant cavity 1 and therefore to a low frequency. The other screw is long and corresponds to a fully inserted piston and therefore to a high frequency since the cavity is smaller. For the sake of convenience, position b will designate the position which corresponds to a low frequency and position h will designate the position which corresponds to a high frequency. In the second place, FIG. 2 shows the entire mechanism in position d or in other words in the unlocked position in which the plate 6 thrusts back the pistons 2 and piston rods 3 so as to ensure decoupling between the piston rod 3 and any one of the adjusting screws 11 among all those which are supported by the carriage 10.

FIGS. 3 and 4 again show the same elements as those illustrated in FIG. 2 but in the positions corresponding to the high frequency in FIG. 3 and to the low frequency in FIG. 4. The high frequency calls for a small resonant cavity and therefore a piston 2 which is fully inserted in the resonant cavity or again for a long adjusting screw 11. In the prior art, the position of the plate 6 is in fact the same in the locking position (position V) irrespective of the frequency and also the length of the adjusting screws 11. In consequence, if the adjusting screws 11 are long, the cup 8 fully compresses the spring 7.

In FIG. 4, consideration is given to the contrary case of low frequency, therefore of a piston 2 which is fully withdrawn with respect to the resonant cavity 1, and of a short adjusting screw 11. The locking position V of the plate 6 is the same as before. In this case, the spring 7 must be of sufficient length to exert a sufficient force on the piston rod 3. It is for this reason that a casing 13 surrounds the spring 7 in order to prevent buckling of the spring under compression by reason of its substantial length.

However, said spring must be sufficiently compressed to overcome the friction forces between the piston and the cavity walls and to ensure good contact on the screws. It must therefore be long, but if it is long, the compressed spring in FIG. 3 must not exert an excessive force. The assembly thus provided results in an increase in bulk of the mechanism since the springs must have a length in the state of rest which is substantial with respect to their stroke or displacement. This disadvantage becomes excessive in the case of tubes which operate at low frequency in the vicinity of 2 or 3 GHz. In this case the pistons and the cavities have large dimensions and therefore exert substantial friction. If the mechanical tuning range is substantial (1.7 to 2.4 GHz, for example), it is found essential to employ long springs having a large diameter and a high modulus.

In order to overcome this disadvantage of bulk resulting from the volume of springs, the invention consists in not adopting the same locking position V for the plate 6 in the case of all channels in order to limit the stroke of the springs. The springs are shorter, less bulky and work within a range corresponding to optimum mechanical characteristics. The difference in positioning of each piston rod 3 with respect to the adjusting screws 11 between the shortest and the longest screw is no longer compensated by the extension or compression of the spring 7 but by the difference in locking position of the plate 6 which supports the springs 7. In accordance with the invention, the distance between the plate 6 and the head of an adjusting screw 11 is constant. Thus, if the position of the screw head changes, the position of the plate 6 changes but the spring 7 is compressed in a constant manner.

Figure 5:
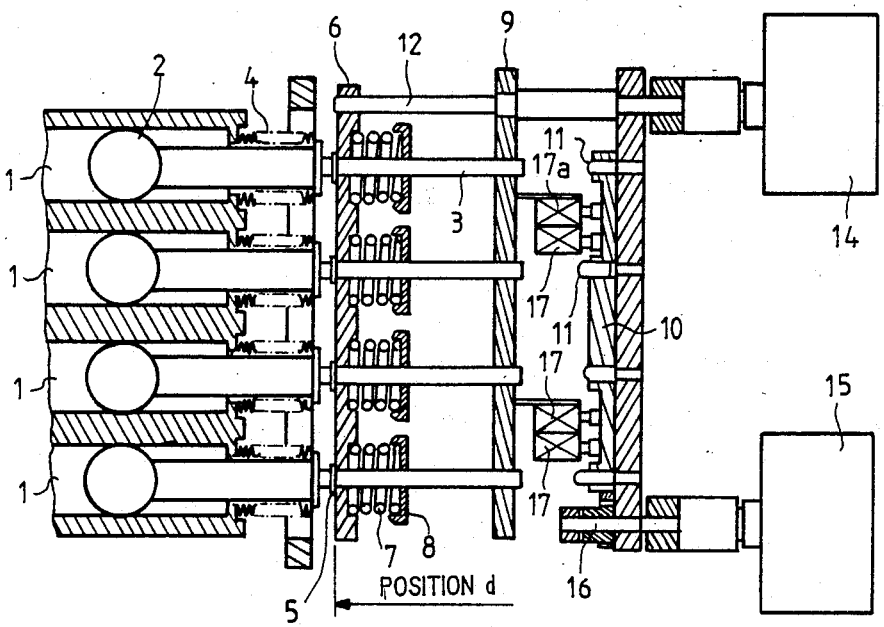
FIG. 5 is a side view illustrating a device in accordance with the invention for mechanical memorization of preadjusted frequency tunings.

FIG. 5 is a side view of the device for memorization of preadjusted frequency tunings in accordance with the invention. A portion of this device is visible in FIG. 5 whilst another portion can more readily be seen in the plan view of FIG. 6.

The device in accordance with the invention makes use of the mechanical assembly which is already known and which has been described in the foregoing with reference to FIG. 1 but completes the assembly with two electric motors 14 and 15. The motor 14 is a locking and unlocking motor and produces action on the set of threaded rods 12 for displacing the plate 6 with respect to the carriage 10 which supports the adjusting screws. The operation of this mechanism will be explained with reference to FIG. 6.

The motor 15 is a channel-changing motor : by means of a gear carried by its shaft and associated with a toothed rack supported by the side of the carriage 10, said motor 15 displaces the carriage and presents a set of adjusting screws 11 in front of the piston rods 3. By means of a control unit (not shown in FIG. 5), the electric motor 15 is permitted to rotate in one direction or in another until one of the switches 17 which corresponds to the desired channel for the klystron indicates to the control unit that the position of the carriage 10 has been reached. This is readily obtained by means of leaf-spring switches so designed that the end of the arm is adapted to carry a roller which falls into a groove cut in the carriage 10.

Figure 6:
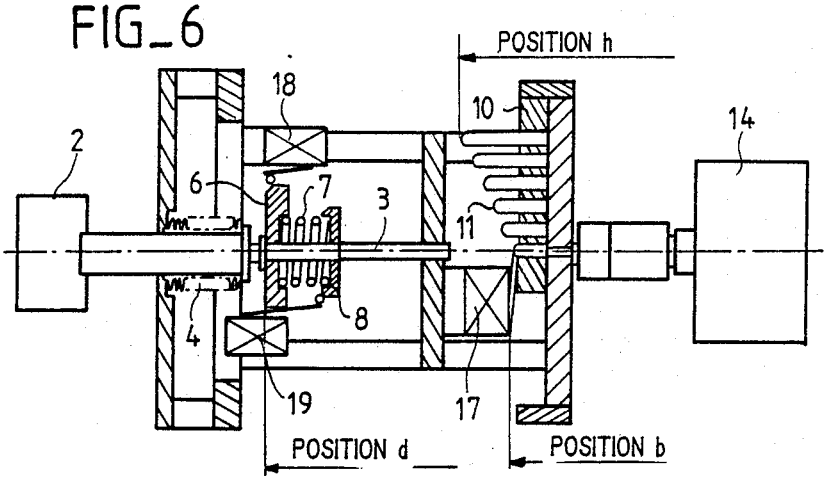
FIG. 6 is a plan view of the memorization device of the preceding figure.

FIG. 6 shows more clearly the operation of the locking and unlocking system by means of the motor 14. This figure also indicates the presence of a switch 18 which is rigidly fixed to the mechanical frame and of a switch 19 for each spring, that is to say for each piston 2. The switch 18 is rigidly fixed to the mechanical frame of the tuning adjustment device and operates when the carriage 6 reaches the end of its travel in the unlocked position. The switch 19 is fixed on the carriage 6 and operates in conjunction with the cup 8. In other words, said switch changes position when the spring 7 has reached a certain length as indicated by the rim of the cup 8.

Figure 7:
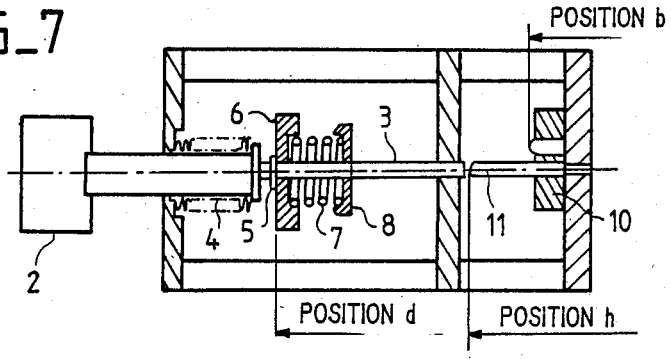
FIGS. 7, 8, 9 show positions of the piston rods and of the springs in the unlocked and locked state at high and low frequencies respectively, in accordance with the invention.

The operation of the device is as follows. Changeover from one channel to another involves a first stage in which the locking-unlocking motor 14 displaces the plate 6 by means of the threaded rods 12 up to the unlocking position designated as d. The end-of-travel signal is given by the switch 18. The pistons are caused to penetrate into the resonant cavities and the piston rods 3 are no longer in contact with the adjusting screws 11 as shown in FIG. 6 and in FIG. 7. As in the prior art, the unlocking position d is always the same when the pistons are in their position of maximum penetration.

In a second stage, the channel-changing motor 15 rotates in a suitable direction as a function of the order given thereto by the control unit until one of the switches 17 corresponding to the desired channel indicated by the control unit is released as a function of the position of the carriage 10, which corresponds to the desired channel.

Figure 8:
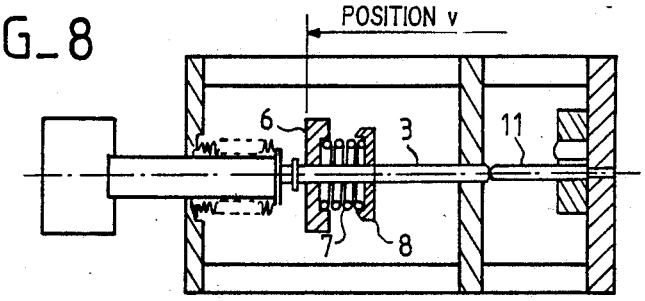
Figure 9:
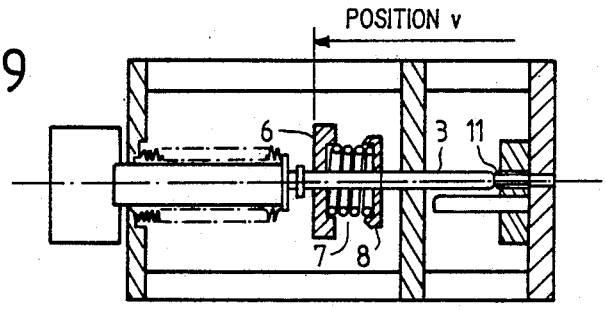

In a third stage as shown in FIGS. 8 and 9, the locking-unlocking motor 14 then rotates in the direction opposite to that of its rotation during the first stage. The plate 6 moves away from the klystron and displaces the piston rods 3 by means of the springs 7 which bear on the cups 8. When a rod 3 comes into contact with its corresponding adjusting screw 11, the spring 7 is compressed under the action of displacement of the plate 6. At a predetermined value of compression, the switch 19 fixed on the plate 6 is sufficiently close to the cup 8 to change state. In respect of a given frequency channel, all the adjusting screws have substantially the same length within a range of approximately one millimeter. When all the switches 19, that is to say one per cavity, have delivered their signal to the control unit, this latter no longer supplies the motor 14. The switches 19 form an AND logic circuit. The klystron is ready to operate on the new frequency.

The locking position V is therefore not fixed but depends on the channel and is reached as soon as all the springs 7 are sufficiently compressed to produce a sufficient pressure between the piston rods 3 and the adjusting screws 11. This compression is very close to the desired optimum value and the cups release their switches within a range of displacement of approximately one millimeter.

The foregoing is illustrated in FIGS. 8 and 9: FIG. 8 corresponds to a high frequency (position h) and to a long adjustment screw while FIG. 9 corresponds to a low frequency (position b) and to a short adjusting screw 11. In comparison with FIGS. 3 and 4, it can be seen that the locking position V is not the same in the two cases of FIGS. 8 and 9. The bearing point of the springs 7, which is constituted by the plate 6, has a position which is variable as a function of the length of the adjusting screw 11 and makes it possible to have a short spring 7 which is capable of working under optimum conditions of compression. Furthermore, coding of the locking and unlocking positions is performed directly on the moving parts consisting of the plate 6 and the cup 8 as well as on the carriage 10 which carries the reference grooves. With respect to the conventional system in which a motor-drive device with cams is added externally to said mechanical assembly for memorizing the position of the pistons, the advantage is twofold:

Accuracy of positioning is enhanced since the moving parts themselves provide information on their localization by means of the switches 17, 18 and 19.

There exists a safety release in the event of failure of the coupling with the motors so that the system cannot be locked if the carriage 10 is not in the desired position.

An additional safety release is also provided by a switch 17*a* in excess with respect to the number of channels of the klystron. For example, as shown in FIG. 6, if there are six sets of adjusting screws 11 for six channels, the device has seven switches 17. If the carriage continues to travel as a result of an error made in the direction of rotation by the control unit or as a result of faulty actuation of a switch, the switch 17*a* in excess with respect to the number of channels interrupts the supply of current to the motor 15 as soon as the carriage 10 is in the end position in either one direction or the other.

The invention applies to motorization of preadjusted frequency tunings for power klystrons in the field of microwave generators for radio communications or radars. The invention is defined in the appended claims.

What is claimed is:

1. A motor-driven device for preadjusted frequency tunings for a klystron, comprising a plurality of resonant cavities, each cavity being adjusted in frequency by means of a piston rigidly fixed to a rod whose position is controlled by a spring which bears on a plate, exerts its force on a cup which is rigidly fixed to the piston rod and locks said rod against the head of an adjusting screw wherein, irrespective of the frequency tuning chosen and in the case of each cavity, the distance between the plate and the head of the adjusting screw is constant, the locking position of the plate being movable according to the frequency which is chosen and the spring being compressed between the plate and the cup in a constant manner.

2. A motor-driven device according to claim 1, wherein a first electric motor carries out the displacement of the movable plate by means of at least one threaded rod and wherein an electric switch rigidly fixed to the wall of the klystron fixes the end of travel of the motor in the unlocked position in which the pistons are fully inserted in the cavities and the rods are decoupled from the adjusting screws.

3. A motor-driven device according to claim 2 wherein, in the case of each cavity, an electric switch fixed on the movable plate controls the compression of the spring by means of the cup whose displacement with respect to the plate initiates changeover of the switch and determines the locked position of the device in which the piston rods are in contact with the adjusting screws.

4. A motor-driven device according to claim 3, wherein the plurality of electric switches corresponding to the same plurality of cavities forms an AND logic circuit which interrupts the supply of current to the locking-unlocking electric motor.

5. A motor-driven device according to claim 1 in which the adjusting screws are supported by a carriage and distributed in series each comprising a number of screws corresponding to the number of cavities, wherein the carriage is displaced by a second electric motor and wherein a plurality of electric switches controls the displacement of the carriage, each switch being adapted to cooperate with a groove cut in the carriage in a position which ensures alignment of a series of adjusting screws with the rods which form extensions of the pistons.

6. A motor-driven device according to claim 5, wherein the number of switches for controlling the displacement of the carriage corresponds to the number of pre-adjusted frequency tunings.

7. A motor-driven device according to claim 5, wherein the displacement of the carriage is controlled in addition by at least one safety switch placed at the ends of travel of the carriage.

* * * * *